US006259377B1

(12) United States Patent
Noecker et al.

(10) Patent No.: US 6,259,377 B1
(45) Date of Patent: Jul. 10, 2001

(54) PROCESS FOR DETECTING AND REPORTING TRAFFIC SITUATION DATA

(75) Inventors: Gerhard Noecker, Goeppingen; Malte Roediger, Ulm, both of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/083,881

(22) Filed: May 26, 1998

(30) Foreign Application Priority Data

May 24, 1997 (DE) ..... 197 21 750

(51) Int. Cl.[7] ..... G08G 1/01
(52) U.S. Cl. ..... 340/933; 340/905
(58) Field of Search ..... 340/933, 905, 340/995; 701/117, 118, 119

(56) References Cited

U.S. PATENT DOCUMENTS

| | | | | |
|---|---|---|---|---|
| 5,146,219 | * | 9/1992 | Zechnall | 340/905 |
| 5,539,645 | * | 7/1996 | Mandhyan et al. | 340/905 |
| 5,760,709 | * | 6/1998 | Hayashi | 340/933 |
| 5,812,069 | * | 9/1998 | Albrecht et al. | 340/905 |
| 5,884,212 | * | 3/1999 | Lion | 340/933 |
| 5,933,100 | * | 8/1999 | Golding | 340/995 |

FOREIGN PATENT DOCUMENTS

| | | |
|---|---|---|
| 195 21 919 | 5/1996 | (DE) . |
| 195 17 309 | 6/1996 | (DE) . |
| 196 43 454 | 4/1998 | (DE) . |
| 06-123635 | 5/1994 | (JP) . |
| WO 95/14292 | 5/1995 | (WO) . |

* cited by examiner

*Primary Examiner*—Jeffery Hofsass
*Assistant Examiner*—John Tweel, Jr.
(74) *Attorney, Agent, or Firm*—Evenson, McKeown, Edwards & Lenahan, P.L.L.C.

(57) ABSTRACT

A process for detecting and reporting traffic situation data of a road system via a respective sample vehicle is provided, in which case an automatic position determination is carried out in the respective sample vehicle at definable points in time and, as a function thereof, pertaining traffic situation data are detected and reported. The road system, together with drive duration data concerning the drive duration to be expected for partial routes of the road system, is stored in the sample vehicles. After a respective position determination, the partial route travelled since the preceding position determination and the pertaining actual drive duration are detected, and via the stored drive duration data, the position to be expected for the actual drive duration and/or the drive duration to be expected for the determined position is determined. Then the deviation is determined between the actual position or drive duration and the expected position or drive duration, after which a traffic situation data reporting operation is triggered only if the deviation is larger than a definable threshold value. The process can be used for obtaining traffic situation data for a highway system.

21 Claims, 1 Drawing Sheet

PROCESS FOR DETECTING AND REPORTING TRAFFIC SITUATION DATA

BACKGROUND AND SUMMARY OF THE INVENTION

This application claims the priority of German Application No. 197 21 750.8, filed May 24, 1997, the disclosure of which is expressly incorporated by reference herein.

The invention relates to a process for detecting and reporting traffic situation data of a road system by means of sample vehicles, in which case, according to the process, in the respective sample vehicle, at predeterminable points in time, an automatic position determination is carried out and pertaining traffic situation data are detected and reported as a function thereof.

Conventionally, traffic situation data, for example, for an automobile road system, are determined based on the infrastructure. As an example, the traffic situation data are determined by measuring instruments in the form of induction loops along the observed road system and are transmitted by way of signal cables to a central information center where they are analyzed by means of special hardware and software and in the process are examined particularly with respect to occurred traffic disturbances. These infrastructure-supported processes require comparatively high expenditures and, in addition, do not permit the recognition of disturbances before their effects are exhibited at at least one measuring point of the road system.

For improving this conventional approach, processes of the above-mentioned type are known which do not require a route-side infrastructure in that the detection and reporting of the traffic situation data is carried out by so-called sample vehicles, also known as "floating cars" which are equipped for this purpose and drive in the considered road system. The term "sample vehicle" has the purpose of expressing that it is sufficient to lay out a comparatively small proportion of all vehicles using the road system in this manner as such sample vehicles for obtaining the traffic situation data, that is, route-related data relevant to assessing the traffic situation in the respective road system. The reporting of the traffic situation data preferably takes place by way of a radio communication path, such as a mobile radio network, to a stationary center and/or other vehicles. A known difficulty of these processes is the fact that the data quantity normally transmitted during each traffic situation data reporting operation is relatively large with respect to the capacity of existing radio networks so that an overloading of the radio networks may occur. In addition, the processing of the large amounts of data requires correspondingly high computing expenditures.

In order to remedy this situation, a process of the above-mentioned type is suggested in German Published Patent Application DE 195 21 919 A1 in the case of which the data quantity to be transmitted is reduced by the fact that the traffic-situation-relevant vehicle and position data detected by the respective sample vehicle are assigned to one or several vehicle and position data classes which correspond to a defined typical vehicle handling, and the assigned class is transmitted as an actual vehicle handling pattern with the position data in the case of a respective reporting operation, especially to a traffic computer. As a result, it is to be achieved that, during a respective reporting operation, the complete data sets of the vehicle data and position data must not be transmitted but only the assigned vehicle handling pattern in the form of an identification which indicates the momentary classification, together with the position data of the sample vehicle.

Another process for determining traffic situation data by means of a sample vehicle fleet with data-quantity-reducing measures is described in German Published Patent Application DE 195 17 309 A1. In the case of this process, the vehicles are divided into exchange groups, in which vehicles of a respective exchange group exchange vehicle data among one another, that is, data concerning the environmental and/or operating condition of the vehicle, and position data; that is, data concerning the position of the respective vehicle at a respective point in time. A selected vehicle of each exchange group transmits the processed vehicle and position data of an exchange group to a central computer, the position data being transmitted periodically after a certain route distance was covered and/or after the expiration of a given time period. For the vehicle data, it can be provided that tolerance values are defined and these are transmitted together with the position data only when a portion of the tolerance values exceed the defined tolerance values.

The invention is based on the technical problem of providing a process of the above-mentioned type by which traffic situation data can be obtained in a reliable manner and at relatively low cost.

The invention achieves this object by providing a process in which the observed road system is stored in the sample vehicles together with the drive duration data concerning the drive duration to be expected for the partial routes of the road system, for example, as digital data, in an electronic memory. After a respective automatic position determination which can be triggered, for example, at defined time intervals or when certain locations of the road system are reached, or when one or several other defined triggering criteria occur, the determined actual position is compared with the position to be expected by means of the stored partial route drive duration data and/or the actual drive duration is compared with the drive duration to be expected by means of the stored partial route drive duration data. The actual drive duration is determined as the time period between the actual and the preceding position determination operation, while the drive duration to be expected can be read directly from the stored drive duration data. Based on the vehicle position known from the preceding position determination operation, the position to be expected is determined in that the point of the subsequently driven partial route of the road system is found by means of the stored road system for which the stored drive duration to be expected corresponds to the time period until the actual position determination operation. Subsequently, a traffic situation data reporting operation will only be triggered if the actual position and/or drive duration deviates by more than a respective definable threshold value from the expected position or drive duration.

Thus, in the case of this process, traffic situation reporting operations do not take place as long as the sample vehicle moves with a tolerance definable by the threshold value within the scope of the drive duration data stored for the individual partial routes of the road system. Expediently, the stored partial route drive duration data correspond to a traffic situation with no disturbances. The absence of traffic situation data reporting operations by a respective sample vehicle is therefore an indication of a traffic situation without disturbances for a possible center and/or for the other vehicles driving in the road system. The transmission of route-related data from a respective sample vehicle in situations without any traffic disturbances, which is unnecessary for recognizing traffic disturbances, is avoided by means of this process, which, on the whole, considerably reduces the amounts of data to be transmitted so that the data communication can take place without any problem on a conventional mobile communication path, such as a digital radio telephone network. If a traffic disturbance, such as a traffic backup, occurs on a partial route travelled by a sample vehicle, this will be reliably recognized during a next position determination of that vehicle in that a significant deviation is recognized of the actual position from the position to be expected according to the stored partial route drive duration data or a correspondingly significant deviation is recognized of the drive duration required for reaching a certain route point from the drive duration to be expected according to the stored drive duration data. This will then, possibly linked to additional triggering conditions, lead to the triggering of a corresponding report of the actual traffic situation data which characterize the traffic situation, that is, the traffic disturbance, deviating from the stored expected traffic situation.

In the case of a process further described herein, the stored drive duration to be expected for the individual partial routes of the road system is not fixedly defined but is defined as a variable which depends at least on the time-of-day and/or the date. As a result, the fact can be taken into account in a simple manner that different drive durations must be expected at least on certain partial routes at certain times-of-day because of a traffic density and/or road condition which fluctuates as a function of the time-of-day, the day of the week and/or the season.

In the case of a process further described herein, the threshold value for the determined position deviations or drive duration variations is not unchangeable but is defined as a variable which depends at least on the variance of the vehicle speed. As a result, different driving conditions can be taken into account in a relatively simple manner. For example, in the case of a typically more fluctuating vehicle speed, a traffic situation data reporting operation is triggered only in the case of a larger deviation of the actual position or drive duration from the position or drive duration to be expected than in the case of lower speed fluctuations. By a correspondingly variable selection of the threshold value, systematic deviations can also be taken into account which may, for example, be based on the fact that for a faster driver drive durations may occur which have the tendency to be shorter than the drive durations to be expected, and vice-versa, for a more careful driver, drive durations may occur which are longer than the drive durations to be expected.

In the case of a process further described herein, reported traffic situation data which point to a certain traffic disturbance are interpreted by a receiving center or by other vehicles as an actual traffic disturbance only if several situation data reports which correspond to one another in this respect are received from the sample vehicle or vehicles within a definable confirmation period. This provides protection against accidental erroneous reports or incorrect traffic disturbance reports by an atypically driven sample vehicle.

In the case of a process further described herein, it is provided that, in the event of the presence of a constant deviation of the actual drive duration from the drive duration to be expected for a definable longer observation period, the actual drive duration for the respective partial route of the road system is stored as a new driving duration to be expected for all vehicles. In addition, in this manner, a drive duration can be stored for the first time for partial routes of the road system for which so far no drive duration to be expected has been available. Also, optionally new partial routes which so far have not been a component of the stored road system can be detected during the first drive by a sample vehicle on these partial routes and can be stored for the first time together with the required drive duration as the drive duration to be expected which correspondingly expands the stored road system.

Other objects, advantages and novel features of the present invention will become apparent from the following detailed description of the invention when considered in conjunction with the accompanying drawings.

DETAILED DESCRIPTION OF THE DRAWINGS

Figure 1:
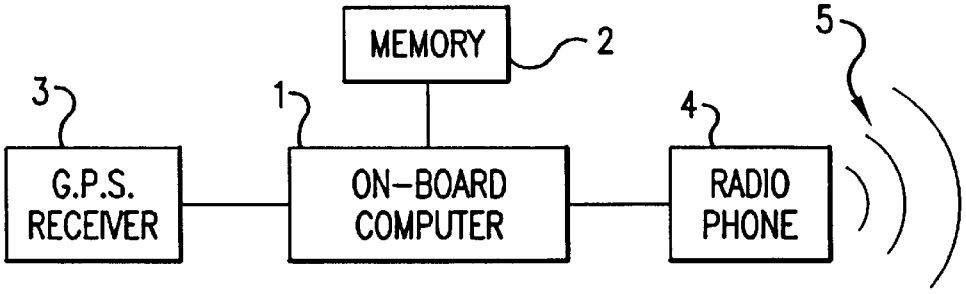
FIG. 1 is a schematic block diagram of a system for detecting and reporting traffic situation data housed in a respective sample vehicle.

The system illustrated in FIG. 1 is installed in a respective sample vehicle by means of which route-related data, such as traffic situation data, can be detected and reported without any route-side infrastructure measures being necessary. The system has a conventional hardware construction which comprises a vehicle-side on-board computer to which a road system memory 2, a vehicle position measuring device in the form of a GPS-receiver 3 or, as an alternative, of another position determining system, and a radio telephone 4 are connected. By way of the GPS-receiver 3, the on-board computer 1 is capable in a conventional manner of automatically determining the vehicle position at desired points in time. In this case, the vehicle computer 1 determines the vehicle position within a road system in which the vehicle travels, for example, a highway system, in which case this road system which can be travelled is stored in the road system memory 2 in digital form in a retrievable manner. The radio telephone 4 is used as a vehicle-side communication instrument for the communication of the vehicle computer 1 with a stationary center which is not shown. Specifically, the communication transmitting device 4 may, for example, be a D-network telephone or a so-called Modakom unit.

For implementing the characteristic process described in the following, in contrast to conventional lay-outs, the vehicle computer 1 and the road system memory 2 are modified with respect to the implemented software or the stored data in a manner which the person skilled in the art can easily obtain from the following explanation of the process which can be carried out by this system and therefore does not have to be explained here in detail. In particular, the road system memory 2 contains not only the data concerning the structure of the road system which can be travelled, including distance information between individual road system points, but additionally drive duration data by means of which a drive duration which is normally to be expected for travelling on the partial route, that is, without the existence of traffic disturbances, is assigned to a respective partial route of the road system. This information concerning the drive duration to be expected which is assigned individually to the respective partial route of the road system can, for example, be determined empirically and can be provided beforehand to the existing sample vehicle or vehicles as well as to a possible stationary center and to the other vehicles travelling in the road system. In this case, the drive duration to be expected for a respective partial route does not have to be defined as an invariable fixed quantity but is preferably assigned to it as a variable which is a function of at least the time-of-day and/or the date. As a result, it can be taken into account that the drive duration to be expected for a certain partial route generally fluctuates with respect to the time of day as well as with respect to whether the drive takes place on a weekday or on the weekend and/or whether winter-type or summer-type road conditions must be expected, which in each case has corresponding effects on the average vehicle speed and therefore the drive duration to be expected.

Figure 2:
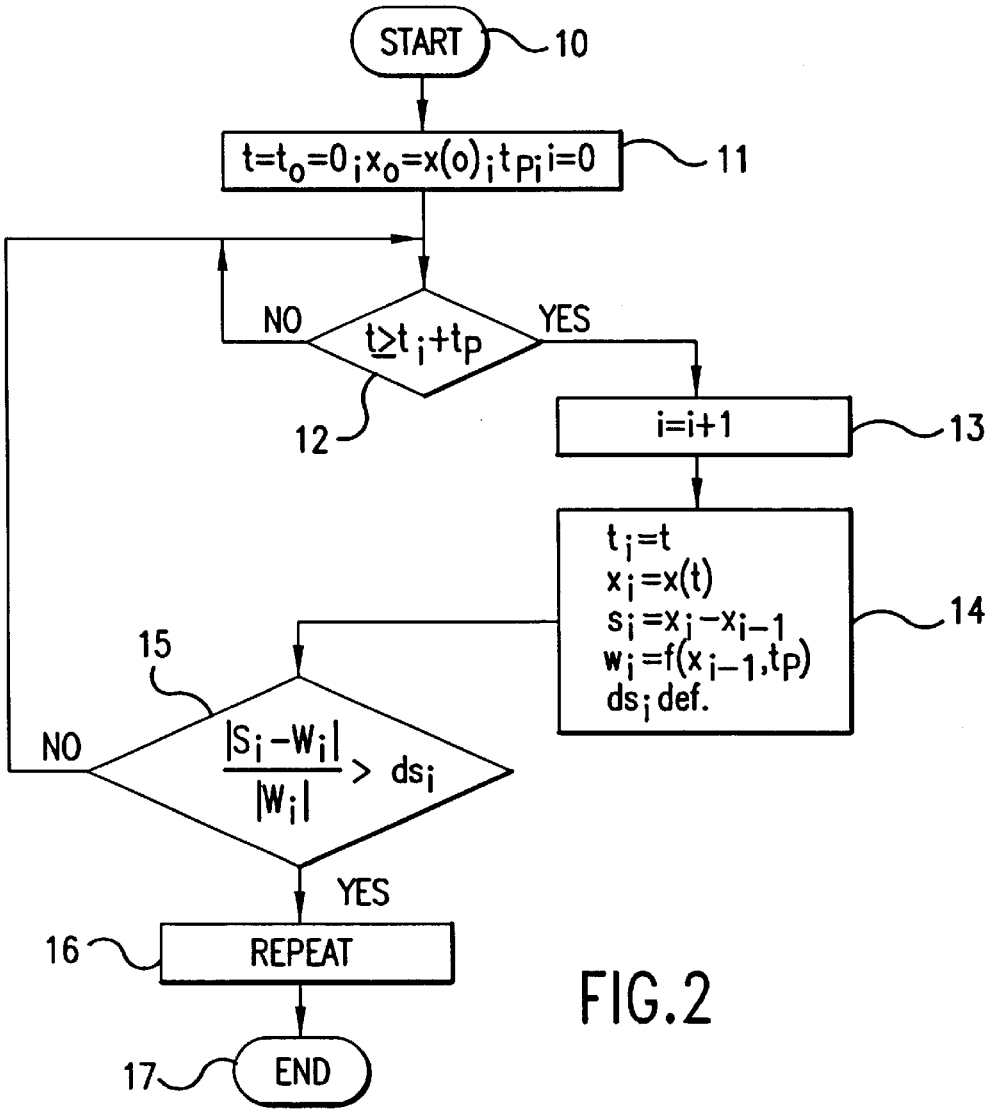
FIG. 2 is a flow chart describing the process for detecting and reporting traffic situation data which can be carried out by the system according to FIG. 1.

In a schematic flow chart, FIG. 2 generally illustrates the essential sequence of the process for detecting and reporting traffic situation data by a respective sample vehicle which can be carried out by the system of FIG. 1. After starting the implementation of the process 10, the required initial conditions are determined in an initialization step 11. This comprises the start of a time counter which continuously detects the time t starting with the initial point in time $t_o=0$. In addition, by means of a corresponding initial position determination, the initial position $x_o=x(0)$ of the corresponding sample vehicle is determined, after whose expiration, in each case a new position determination is to be carried out. As an alternative, the position determinations carried out at definable points in time can also in each case take place when the vehicle has reached certain road system points; that is, the end point of a respective partial route of a road system to which a certain drive duration to be expected is assigned. As another alternative, a triggering of position determination operations can be provided by certain events, specifically, for example, after a hard braking operation with a subsequent operation of the emergency flasher as the expected end of the backup. In the case of this alternative, in addition to the determined position, information concerning the triggering event will then also be transmitted. In addition, in all alternatives, an event counter with a count value i, which detects the number of carried out position determinations, is initially set to zero.

Subsequently, it is continuously queried (step 12) whether, since the point in time $t_i$ of the initialization or of a preceding position determination, the given time period $t_p$ has elapsed; that is whether $t \geqq t_i+t_p$ applies. Only when this condition has been met, in the next step 13, the position determination event count value i is increased by one and then the vehicle position $x_i=(t)$ is determined at this point in time. In the corresponding position determination step 14, the pertaining position determination point in time $t_i$ is then set to the corresponding time value t of the time counter, and route distance $s_i=x_i-x_{i-1}$ covered since the preceding position determination or initialization is computed as the difference between the presently determined vehicle position $x_i$ and the previously determined vehicle position $x_{i-1}$. In addition, the vehicle computer 1 determines as a function $f(x_{1-1}, t_p)$ of the last measured position $x_{i-1}$ and of the time $t_p$ elapsed since then that route distance $w_i$ which, based on the last measured vehicle position $x_{i-1}$, is to be expected as the distance covered by the vehicle during the time period $t_p$ elapsed in the interim, on the basis of the drive duration to be expected and stored for the concerned travelled partial route of the road system, in the case of disturbance-free traffic. It is clear that the actual route distance $s_i$ as well as the route distance $w_i$ to be expected must not be understood as pure distance information but, in addition, contain the information concerning the pertaining partial route of the road system on which the vehicle has travelled since the preceding position determination. For example, the measured distance $s_i$ and the determined distance to be expected $w_i$ must be considered to differ from one another if, although they are the same distances, they relate to partial routes of the road system extending in different directions.

In addition, in the position determination step 14, a threshold value is defined in the form of a percentage-type deviation amount $ds_i$, by which the actual route distance $s_i$ may deviate from the determined route distance $w_i$ to be expected, without leading to the triggering of a traffic situation data reporting operation. Preferably, this deviation amount $ds_i$ is not defined as a fixed value but is newly defined for each position determination operation as a variable quantity which, in a predetermined manner, depends on vehicle condition parameters and/or vehicle environment parameters. Specifically, the permissible deviation amount $ds_i$ is determined as a function of the variance of the momentary speed of the sample vehicle so that, for example, in the case of a strong fluctuation of the vehicle speed, it can be set to a higher value than at lower speed fluctuations in order to avoid unnecessarily frequent traffic situation data reporting operations in the case of temporarily stronger fluctuations of the vehicle speed.

In a subsequent query step 15, the vehicle computer 1 determines whether the percentage deviation of the difference between the actually covered route distance $s_i$ and the route distance $w_i$ to be expected which is determined for the travelled partial route has exceeded the defined deviation amount $ds_i$. If this is not so, a reporting of traffic situation data does not take place and the process sequence returns to in front of query step 12, whereupon a new position determination event is awaited. If, in contrast, the permissible defined deviation amount $ds_i$ is exceeded, this is assessed by the vehicle computer 1 as an occurred release of a traffic situation data reporting operation (step 16). According to the application, the actual triggering of the concerned reporting operation can be linked to additional conditions; for example, to whether the vehicle computer 1 observes an abrupt braking operation or the setting of the emergency blinker, which can point to a starting backup and should therefore trigger the automatic triggering of a traffic situation data reporting operation, and/or whether a filler cap or a door of the vehicle is opened up, which points to an intermediate stop caused by the driver and is not caused by the traffic situation and therefore does not require the triggering of a traffic situation data reporting operation.

Irrespective of whether in the corresponding process step 16 a traffic situation data reporting operation is triggered already on the basis of the exceeding of the defined deviation amount $ds_i$ or only when further conditions are met, by means of the present event-discrete process, fewer data transmission operations are required by way of the mobile communication path 5. This clearly reduces their respective load and the connected expenditures in comparison to the above-mentioned conventional approaches. After the concluded reporting operation, a process cycle is concluded when the cycle end 17 is reached, and, for a new cycle, the process returns to query step 12 as long as no system switch-off has taken place. The process, whose rough course is illustrated in FIG. 2, as required, can also be further refined. Thus, for example, the reliability of the traffic situation report can be increased by an individually adjustable factor which, starting at the beginning of the drive, that is, from the point in time $t_o$ of the initialization, constantly compares the actual with the determined drive duration to be expected and takes into account systematic deviations. Such deviations may, for example, be present in such a manner that a sample vehicle driven by a fast driver has the tendency to have lower actual drive durations than the drive durations to be expected, while vice-versa, for a more careful driver, the actual drive duration has the tendency to be longer than the drive duration to be expected.

The traffic situation data reported after the triggering of a corresponding reporting operation in step 16 by the vehicle computer 1 by way of the communication transmitting instrument 4 and the mobile radio path 5 are transmitted to the stationary center and/or directly as a broadcast to all or to certain vehicles, for example, the vehicles situated in the proximity of the sample vehicle. On the receiver side, the reported traffic situation data can then be analyzed by the center or the informed vehicles in a desirable manner. For example, as protection against one-time accidental erroneous reports, the analysis may comprise the measure that a traffic disturbance reported by a certain traffic situation data reporting operation is considered as such only if it is confirmed within a certain definable observation time period by a traffic situation data report of the same content which uses as a condition a later position determination of the same vehicle or of another sample vehicle. Preferably, a confirmation is provided in this case which uses as a condition the identical report of several sample vehicles in order to avoid erroneous traffic disturbance reports from a single inexpediently driven sample vehicle.

As another advantageous analyzing measure, the center and/or the individual vehicles can be capable of assessing the fact that, for an extended period of time, identical traffic situation data reports have been received which signal a constant deviation of the actual drive duration from the stored drive duration to be expected for the corresponding route distance, as an indication of new drive duration to be expected for this partial route. In this case, the center and/or the participating vehicles will write over the driving duration to be expected and stored so far in the memory for the corresponding partial route the actual drive duration transmitted by the traffic situation data reports as a new drive duration to be expected. By means of this measure, it is also possible to assign for the first time such a drive duration to be expected to partial routes of the stored road system which so far had not been assigned a drive duration to be expected. In this manner, as required, all drive duration data can be assigned in the continuous driving operation of the sample vehicle or vehicles to a road system which so far had been stored without these data, whereby an empirical preliminary determination of the partial-route-related drive durations will no longer be necessary. Further, in this manner, even partial routes not yet contained in the stored road system can be reported together with the pertaining drive duration by a sample vehicle driving on them so that the road systems stored in the center and/or the other vehicles can be expanded by this partial route together with the pertaining drive duration to be expected.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A process for detecting and reporting traffic situation data of a road system via a respective sample vehicle, in which at least one position determination triggering criteria is defined and, in the respective sample vehicle, in each case an automatic position determination is carried out in an event of an occurrence of the triggering criteria and, as a function thereof, pertaining traffic situation data is detected and reported, the process comprising the acts of:

storing the road system, together with drive duration data concerning drive durations to be expected for partial routes of the road system, in the respective sample vehicle;

after a respective automatic determination of an actual position, detecting a partial route of the road system travelled since the preceding position determination and the pertaining actual drive duration, and determining the position to be expected ($w_i+x_{i-1}$) for the actual drive duration and/or the drive duration to be expected for the actual position via the stored partial route drive duration data;

comparing the actual position with the position to be expected, and/or comparing the actual drive duration with the drive duration to be expected; and triggering a traffic situation data reporting operation only if the actual position and/or actual drive duration deviates by more than a respective definable threshold value from the position to be expected or drive duration to be expected.

2. The process according to claim 1, further comprising the act of defining the drive duration to be expected and stored for a respective partial route of the road system as a variable which is at least a function of a time of day or of a date.

3. The process according to claim 1, further comprising the act of defining the threshold value as a variable which is a function of at least a variance of a momentary vehicle speed of the respective sample vehicle.

4. The process according to claim 2, further comprising the act of defining the threshold value as a variable which is a function of at least a variance of a momentary vehicle speed of the respective sample vehicle.

5. The process according to claim 1, further comprising the act of assessing traffic disturbance information contained in a respective traffic situation data report on a receiver side as an actual traffic disturbance only if, within a definable confirmation period, at least one identical additional traffic situation data report is received which was transmitted by another sample vehicle.

6. The process according to claim 2, further comprising the act of assessing traffic disturbance information contained in a respective traffic situation data report on a receiver side as an actual traffic disturbance only if, within a definable confirmation period, at least one identical additional traffic situation data report is received which was transmitted by another sample vehicle.

7. The process according to claim 3, further comprising the act of assessing traffic disturbance information contained in a respective traffic situation data report on a receiver side as an actual traffic disturbance only if, within a definable confirmation period, at least one identical additional traffic situation data report is received which was transmitted by another sample vehicle.

8. The process according to claim 1, further comprising the act of storing a reported actual drive duration as a new drive duration to be expected for a respective partial route if, on a receiver side, traffic situation data reports are received for a definable observation period which, in an identical manner, indicate a constant deviation of the actual drive duration from the stored drive duration to be expected for the respective partial route.

9. The process according to claim 2, further comprising the act of storing a reported actual drive duration as a new drive duration to be expected for a respective partial route if, on a receiver side, traffic situation data reports are received for a definable observation period which, in an identical manner, indicate a constant deviation of the actual drive duration from the stored drive duration to be expected for the respective partial route.

10. The process according to claim 3, further comprising the act of storing a reported actual drive duration as a new drive duration to be expected for a respective partial route if, on a receiver side, traffic situation data reports are received for a definable observation period which, in an identical manner, indicate a constant deviation of the actual drive duration from the stored drive duration to be expected for the respective partial route.

11. The process according to claim 5, further comprising the act of storing a reported actual drive duration as a new drive duration to be expected for a respective partial route if, on a receiver side, traffic situation data reports are received for a definable observation period which, in an identical manner, indicate a constant deviation of the actual drive duration from the stored drive duration to be expected for the respective partial route.

12. A computer software product, comprising a computer readable medium, said computer readable medium having stored thereon code segments which:

(a) store a road system, together with drive duration data concerning drive durations to be expected for partial routes of the road system, in a respective sample vehicle;

(b) after a respective automatic determination of an actual position, detect a partial route of the road system travelled since the preceding position determination and the pertaining actual drive duration, and determine the position to be expected for the actual drive duration and/or the drive duration to be expected for the actual position via the stored partial route drive duration data;

(c) compare the actual position with the position to be expected, and/or the actual drive duration with the drive duration to be expected; and (d) trigger a traffic data situation data reporting operation only if the actual position and/or actual drive duration deviates by more than a respective definable threshold value from the position to be expected or drive duration to be expected.

13. A computer software product according to claim 12, further comprising a code segment stored on the medium which defines the drive duration to be expected and stored for a respective partial route of the road system as a variable which is at least a function of a time of day or of a date.

14. A computer software product according to claim 12, further comprising a code segment stored on the medium which defines the threshold value as a variable which is a function of at least a variance of a momentary vehicle speed of the respective sample vehicle.

15. A computer software product according to claim 12, further comprising a code segment stored on the medium which assesses traffic disturbance information contained in a respective traffic situation data report on a receiver side as an actual traffic disturbance only if, within a definable confirmation period, at least one identical additional traffic situation data report is received which was transmitted by another sample vehicle.

16. A computer software product according to claim 12, further comprising a code segment stored on the medium which stores a reported actual drive duration as a new drive duration to be expected for a respective partial route if, on a receiver side, traffic situation data reports are received for a definable observation period which, in an identical manner, indicate a constant deviation of the actual drive duration from the stored drive duration to be expected for the respective partial route.

17. A system for detecting and reporting traffic situation data of a road system via a respective sample vehicle, in which at least one position determination triggering criteria is defined and, in the respective sample vehicle, in each case an automatic position determination is carried out in an event of an occurrence of the triggering criteria and, as a function thereof, pertaining traffic situation data is detected and reported, the system comprising:

means for storing the road system, together with drive duration data concerning drive durations to be expected for partial routes of the road system, in the respective sample vehicle;

means for, after a respective automatic determination of an actual position, detecting a partial route of the road system travelled since the preceding position determination and the pertaining actual drive duration and determining the position to be expected for the actual drive duration and/or the drive duration to be expected for the actual position via the stored partial route drive duration data;

means for comparing the actual position with the position to be expected, and/or comparing the actual drive duration with the drive duration to be expected; and means for triggering a traffic situation data reporting operation only if the actual position and/or actual drive duration deviates by more than a respective definable threshold value from the position to be expected or drive duration to be expected.

18. The system according to claim 17, further comprising means for defining the drive duration to be expected and stored for a respective partial route of the road system as a variable which is at least a function of a time of day or of a date.

19. The system according to claim 17, further comprising means for defining the threshold value as a variable which is a function of at least a variance of a momentary vehicle speed of the respective sample vehicle.

20. The system according to claim 17, further comprising means for assessing traffic disturbance information contained in a respective traffic situation data report on a receiver side as an actual traffic disturbance only if, within a definable confirmation period, at least one identical additional traffic situation data report is received which was transmitted by another sample vehicle.

21. The system according to claim 17, further comprising means for storing a reported actual drive duration as a new drive duration to be expected for a respective partial route if, on a receiver side, traffic situation data reports are received for a definable observation period which, in an identical manner, indicate a constant deviation of the actual drive duration from the stored drive duration to be expected for the respective partial route.

* * * * *